US005645170A

United States Patent [19]

Hornung

[11] Patent Number: 5,645,170

[45] Date of Patent: Jul. 8, 1997

[54] TAPE PACKAGING SYSTEM FOR ELECTRICAL TERMINALS

[75] Inventor: Craig W. Hornung, Harrisburg, Pa.

[73] Assignee: The Whitaker Corporation, Wilmington, Del.

[21] Appl. No.: 431,207

[22] Filed: Apr. 28, 1995

[51] Int. Cl.[6] ..... B65D 73/02; B65D 85/20; B65B 19/34

[52] U.S. Cl. ..... 206/714; 53/399; 53/444; 53/445; 206/344; 206/443

[58] Field of Search ..... 206/338, 342, 206/343, 344, 345, 713, 715, 714, 717, 820, 390, 443; 53/399, 444, 445

[56] References Cited

U.S. PATENT DOCUMENTS

| | | | |
|---|---|---|---|
| 2,982,595 | 5/1961 | Rogers, Jr. | 206/344 X |
| 3,357,761 | 12/1967 | Langas et al. | 206/344 X |
| 3,471,008 | 10/1969 | Reich et al. | 206/344 |
| 3,545,606 | 12/1970 | Bennett | 206/820 X |
| 3,974,913 | 8/1976 | Hirsch | 206/344 |
| 4,024,953 | 5/1977 | Nailor, III | 206/344 |
| 4,033,456 | 7/1977 | Wion et al. | 206/715 X |
| 5,092,026 | 3/1992 | Klemmer et al. . | |
| 5,095,599 | 3/1992 | Gloe et al. . | |
| 5,228,326 | 7/1993 | Wasilko et al. . | |
| 5,275,032 | 1/1994 | Gloe et al. . | |
| 5,323,634 | 6/1994 | Wolfe et al. . | |
| 5,337,589 | 8/1994 | Gloe et al. . | |
| 5,409,111 | 4/1995 | Takumi | 206/344 |

*Primary Examiner*—Bryon P. Gehman

[57] ABSTRACT

A tape and terminal package (30, 84) is disclosed wherein terminals (52, 86, 88) of different relative sizes are positioned on a carrier tape (32) so that each is a standard height (64) above the surface (66) of the tape and a crimping zone (58, 96, 98) of each terminal is a standard distance (68) from a datum (62) on the tape. A shim tape (76, 92) is arranged between the smaller terminals (52-2, 88) and the carrier tape (32) to position them to the standard height (64), each different terminal having a specific thickness shim tape (76, 92). In this way, two or more different tape and terminal packages (30, 94), each package having terminals of a different size or type than the other packages, can be accommodated by a single applicator tool (50) without modification or adjustment. Additionally, a tape and terminal package having terminals of different sizes or types on the same carrier tape may be accommodated by a single applicator tool.

14 Claims, 5 Drawing Sheets

Fig. 4
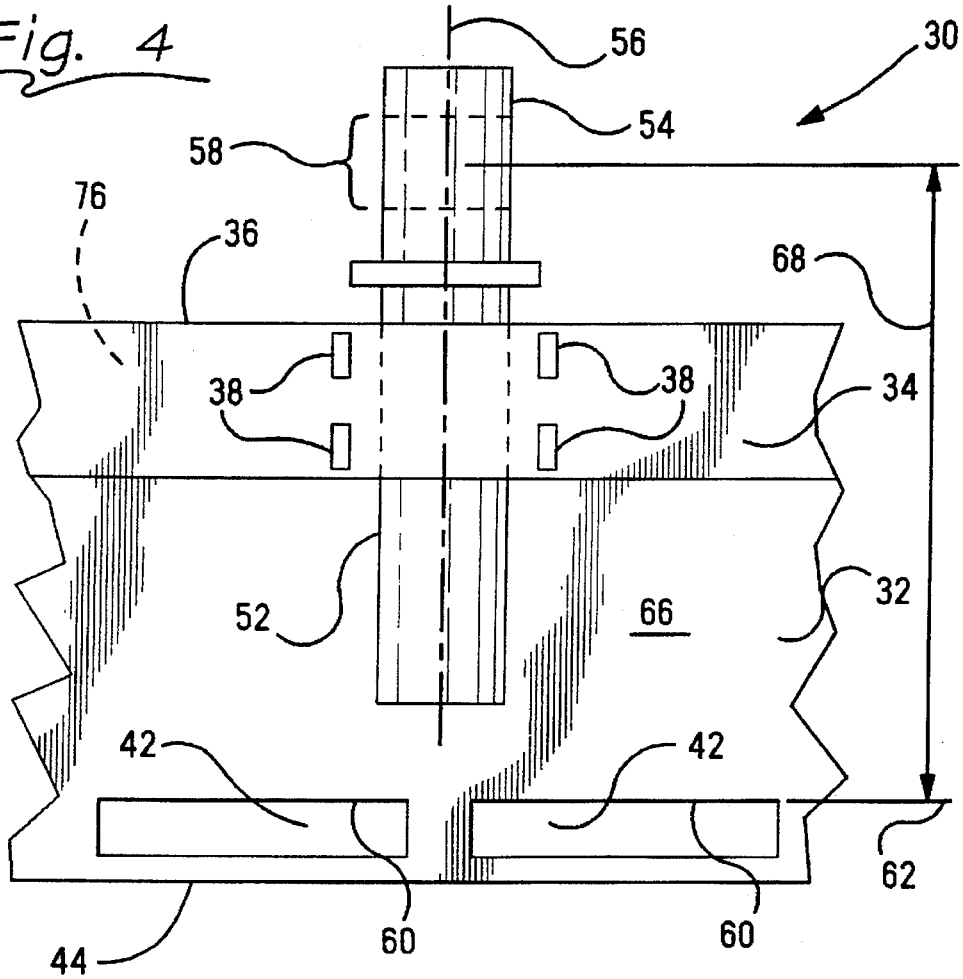
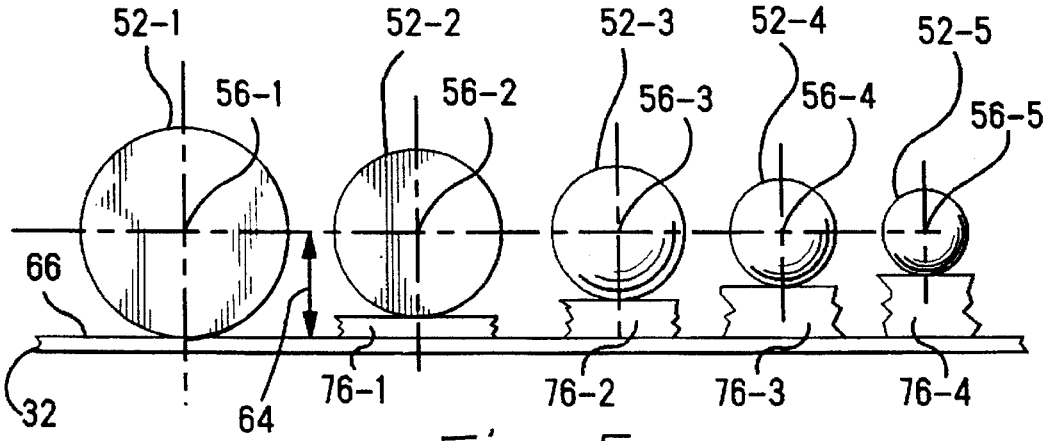
Fig. 5

TAPE PACKAGING SYSTEM FOR ELECTRICAL TERMINALS

The present invention relates to tape packaging systems for holding and positioning electrical terminals within a workstation in a tool for attaching the terminal to a conductor.

BACKGROUND OF THE INVENTION

In the electrical industry, tools and machines that attach electrical terminals to conductors commonly accept carrier tape having the terminals attached thereto. Such tools and machines include a tape feed system that guides and feeds the tape so that the individual terminals are moved into position within a workstation where the crimping operation takes place. An example of such a carrier tape and terminals is shown in FIGS. 1 and 2. There, a carrier tape 10 is shown having a plurality of electrical terminals 12 held in place by means of a cover tape 14 which is ultrasonically welded in place, at the points 16, in the usual manner. The carrier strip 10 includes a row of rectangular openings 18 along an edge 20 thereof that are used for feeding the strip in a crimping apparatus. Each terminal has an axis 22 that is perpendicular to the longitudinal axis 24 of the carrier tape. The longitudinal axis 24, edge 20, or an edge 26 of the openings 18 can serve as a datum from which the terminals 12 are accurately positioned on the carrier tape 10 so that when the tape is fed into the workstation, the crimping zone 28 of the terminal can be accurately positioned with respect to the crimping dies. Optionally, a layer of adhesive tape 30 may be placed between the cover tape 14 and the terminal 12, extending between the cover tape 14 and the surface of the carrier tape 10, as shown in FIG. 2, to aid in terminal retention. The tooling that receives the barrel end 32 of the terminal 12 includes a positioner that receives and aligns each terminal as it is fed into the workstation for crimping. Because a given tool must accommodate a range of different terminals, there must be a different positioner for each different terminal. Additionally, some terminals, such as wire nuts, splices, or wire connectors, have different external configurations for similar conductor sizes, requiring a different positioner for each. This requires that the tool be customized for each different terminal being used and becomes inconvenient when different terminals are constantly being terminated. A range of terminals, as used herein, is defined as a group of different terminals, each of which requires a different crimp height than the other terminals in the range, and wherein a single applicator tool can accommodate all of the terminals in the range.

What is needed is a package system for electrical terminals that positions each terminal on the carrier tape so that its crimping zone is a standard distance from both the surface of the tape and from the datum. This would obviate the need for positioners and allow for different terminals to be packaged on the same tape for use sequentially in the same tool.

SUMMARY OF THE INVENTION

A package containing a plurality of electrical terminals is provided for holding and accurately positioning each of the terminals, in seriatim, both axially and laterally with respect to a workstation in a tool that electrically and mechanically attaches the terminal to a conductor. The package includes a carrier tape having a width, a length, a major surface, and a datum running along the length, and a cover tape attached to the major surface of the carrier tape, thereby forming a plurality of pockets along the major surface. A plurality of electrical terminals are provided, each of which includes a crimping barrel having a longitudinal centerline and a crimping zone. Each of the terminals is held in a respective one of the pockets so that its crimping zone is spaced a standardized distance from the datum. The plurality of terminals is taken from a range of different terminals. A shim tape is disposed between at least some of the terminals and the major surface of the carrier tape to position the terminals at a standard height above the surface of the carrier tape.

DESCRIPTION OF THE FIGURES

FIG. 4 is a plan view of the carrier tape and terminal package shown in FIG. 3;

FIG. 5 is a schematic representation of a range of terminals that are accommodated by the tool shown in FIG. 3;

DESCRIPTION OF THE PREFERRED EMBODIMENT

Figure 1:
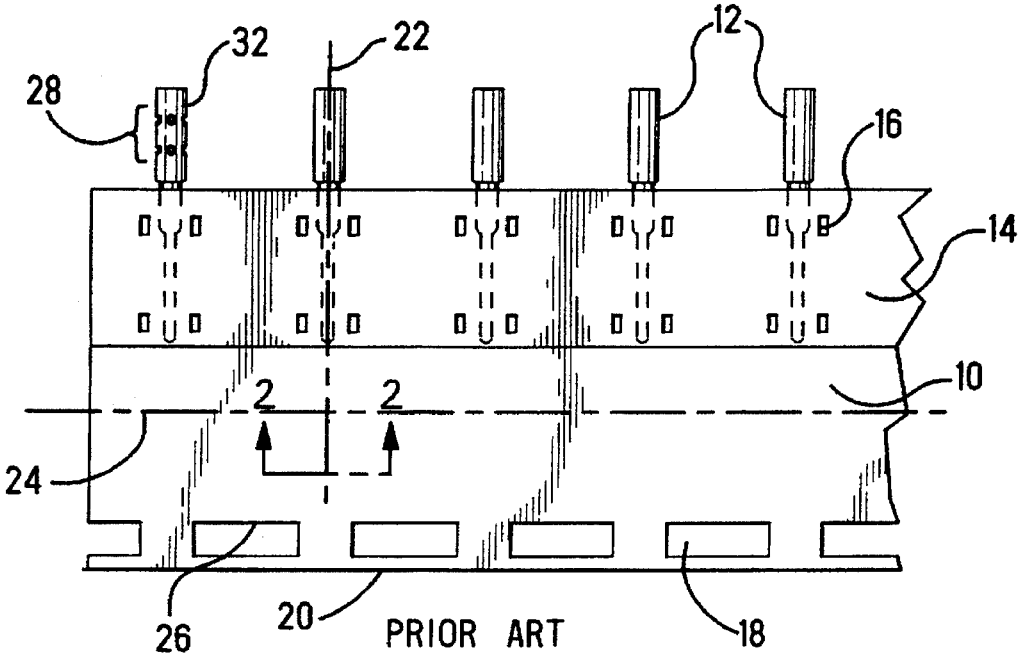
PRIOR ART Fig. 1
FIG. 1 is a plan view of a prior art carrier tape with attached terminals.
Figure 2:
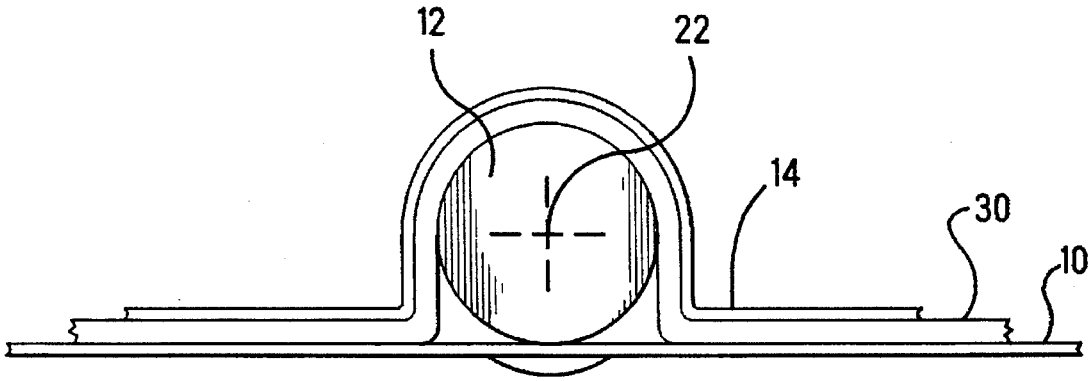
PRIOR ART Fig. 2
FIG. 2 is a cross-sectional view taken along line 2—2 in FIG. 1.
Figure 3:
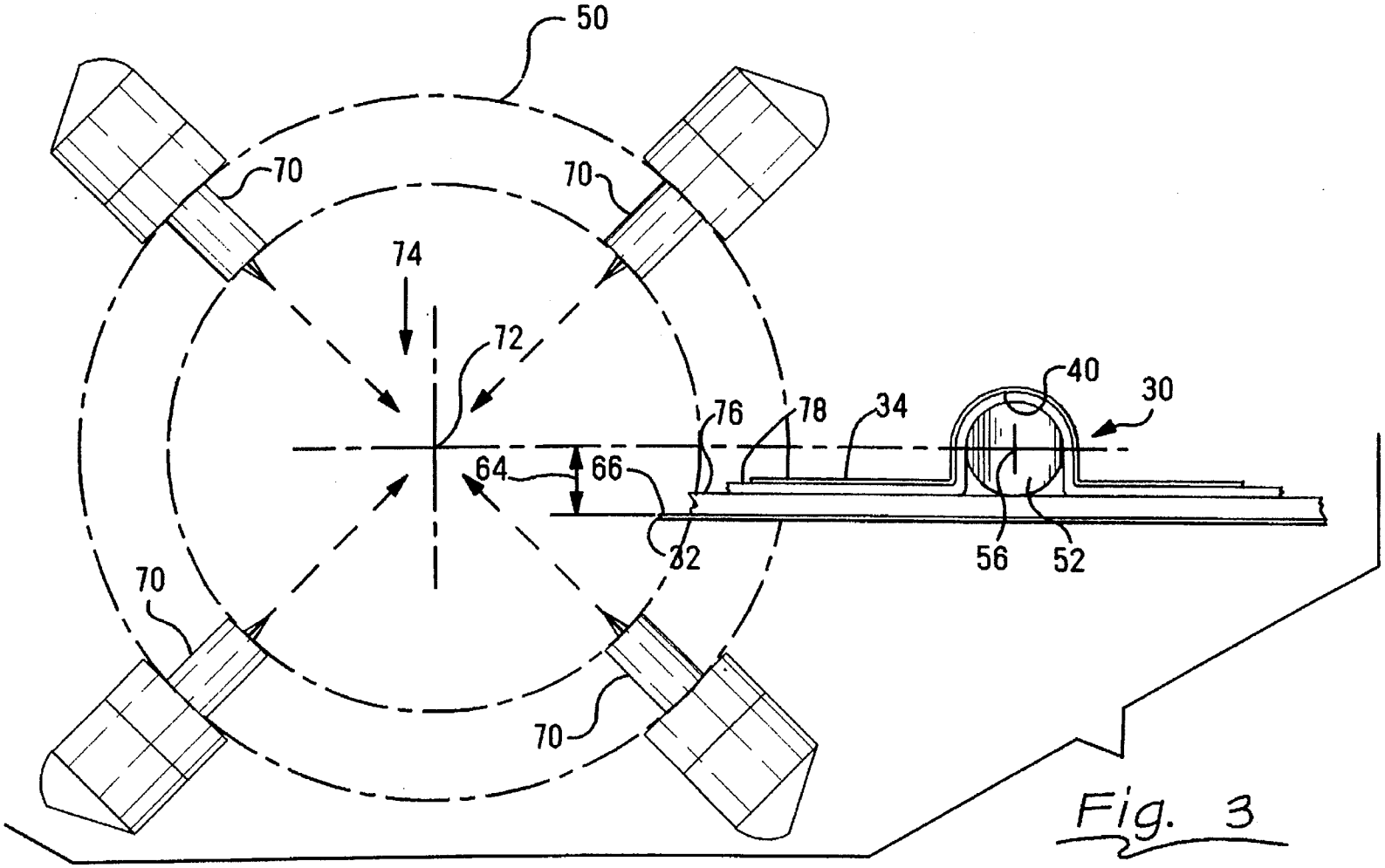
FIG. 3 is a side view of a portion of a carrier tape and terminal package incorporating the teachings of the present invention, and showing a schematic representation of a crimping tool in relation thereto.

There is shown in FIGS. 3 and 4 a tape and terminal packaging 30 having a carrier tape 32 and a cover tape 34 that is arranged along an edge 36 of the carrier tape and held in place by ultrasonic welds 38 to form a plurality of pockets 40 along the length of the carrier tape, in the usual manner. A series of rectangular openings 42 are formed in the carrier tape 32 adjacent to an edge 44 opposite the edge 36 for engagement by a feed mechanism in a crimping tool, schematically indicated at 50 in FIG. 3. Each pocket 40 contains a terminal 52, each including a barrel 54 having an axis 56 and a crimp zone 58, as best seen in FIG. 4. Edges 60 of the rectangular feed openings 42 define a datum 62 with reference to which the terminal 52 is accurately positioned. The axis or centerline 56 is longitudinally positioned along the tape in conformance with the requirements of the feed mechanism, is perpendicular to the datum 62, and is positioned a standard height 64 above a major surface 66 of the tape 32. The crimping zone 58 is spaced from the datum 62 a predetermined standard distance 68. As shown in FIG. 3, the tool 50 includes four indentors 70 equally spaced about a center 72 of a workstation 74, where the crimping of the terminal 52 takes place. As the carrier tape 32 is fed to the left, as viewed in FIG. 3, the centerline 56, or terminal axis, becomes aligned with the center 72, and the crimp zone 58 becomes aligned with the indentors 70. This occurs because the height 64 and the distance 68 are standardized for the particular tool 50 and for the tape and terminal package 30. The standard height 64 is controlled by providing a shim tape 76 of the desired thickness between the terminal 52 and the surface 66 of the carrier tape 32. As with prior art tape packaging systems, a layer of adhesive tape 78 is optionally disposed between the cover tape 34 and the terminal 52 to aid in terminal retention.

Each tool 50 is designed to accommodate a range of several different terminals 52. For example, FIG. 5 depicts a hypothetical range of different terminals 52-1 through 52-5, each having its own carrier tape and terminal package 30, that can be accommodated by the tool 50. In this example, the largest terminal 52-1 is positioned directly on the surface 66 of the carrier tape 32 while the other smaller diameter terminals 52-2 through 52-5 have shim tape 76-1 through 76-4, respectively, disposed between the terminal and the surface 66. The shim tapes 76-1 through 76-4 have different thicknesses which are selected to position their respective terminals 52-2 through 52-5 so that the respective terminal centers 56-2 through 56-5 are spaced above the surface 66 of the carrier tape 32 by a dimension equal to the standard height 64, as shown in FIG. 5. This arrangement permits a carrier tape 32 containing a plurality of the terminals 52-5 to be processed by the tool 50 interchangeably with a carrier tape containing a plurality of the terminals 52-1, or with other carrier tapes 32 containing the other terminals in the range. Since the various carrier tape and terminal packages within the range are interchangeable in the tool 50, there is no need for additional positioning devices that engage the terminal and move it into the desired position, as with prior art tools and terminal packaging systems.

Figure 6:
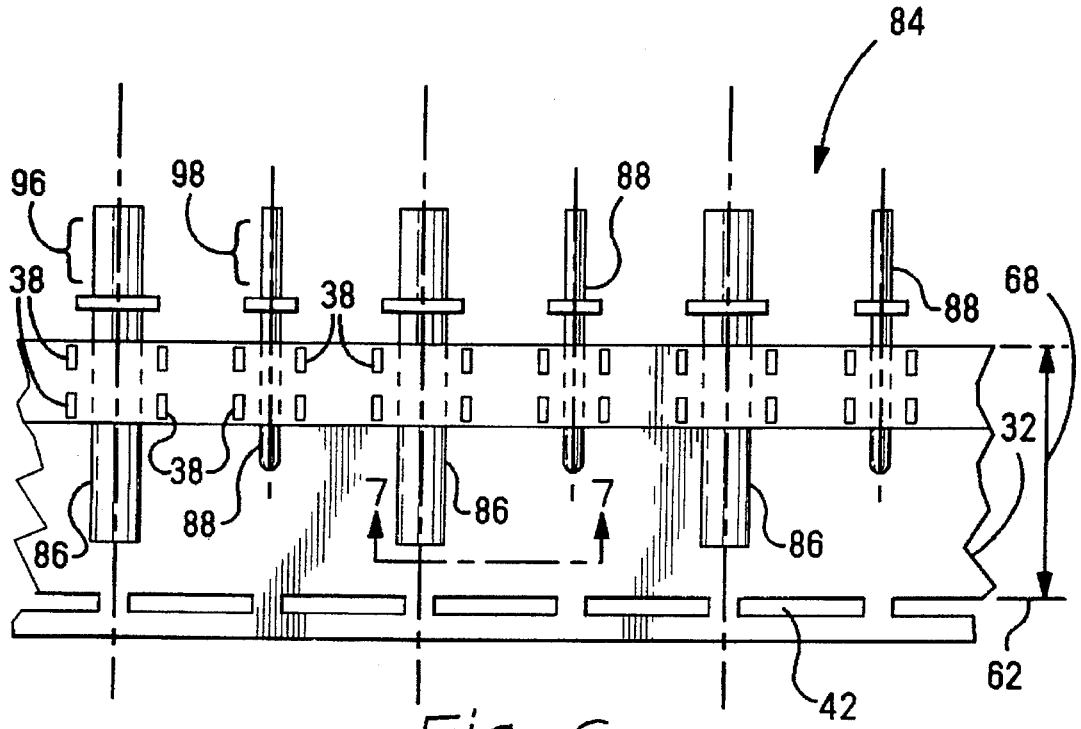
FIG. 6 is a plan view of another embodiment of a carrier tape and terminal package.
Figure 7:
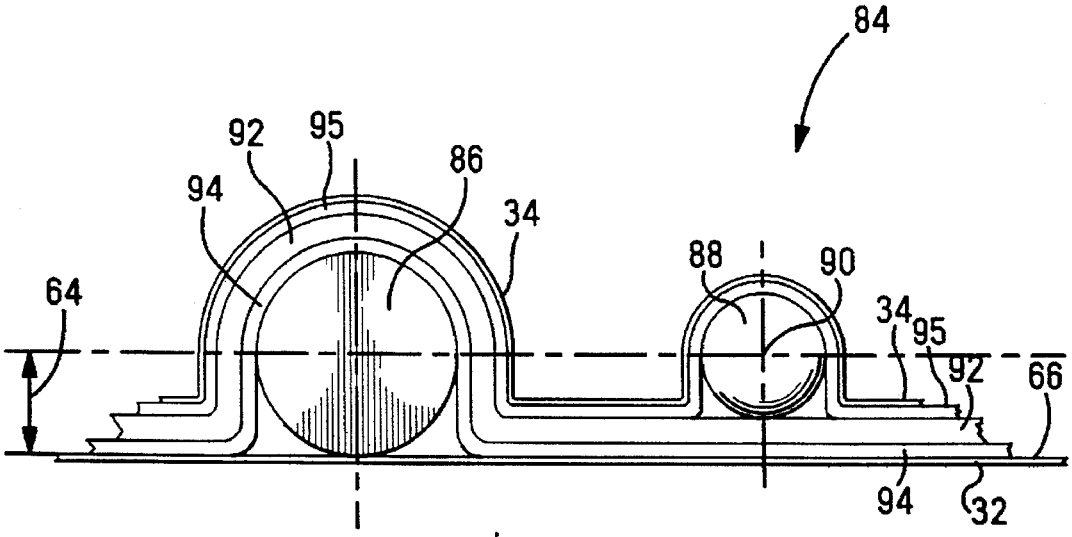
FIG. 7 is a cross-sectional view taken along line 7—7 in FIG. 6.

During certain manufacturing operations it is necessary to work with different terminals in rapid succession. That is, a terminal of one size or type may be terminated to a conductor in a unit being manufactured, followed by the termination of another different terminal to a different conductor in the same unit. Rather than providing two of the tools 50, each with its own carrier tape and terminal package, a single package having the two terminals arranged thereon so as to permit termination by a single tool would be desirable. Such a tape and terminal package 84 is shown in FIGS. 6 and 7. There, a carrier tape 32 is shown having rectangular feed openings 42 therein. Two terminals 86 and 88 of different sizes are alternately arranged in the package 84. The larger terminal 86, as shown in FIG. 7, is positioned directly on the surface 66 of the carrier tape 32, while the smaller terminal 88 has its center or axis 90 spaced above the surface 66 by an amount equal to the standard height 64. This spacing is effected by inserting a shim tape 92 of the correct thickness between the terminal 88 and the carrier tape 32, as shown in FIG. 7. In this example, an optional first layer of adhesive tape 94 is disposed over the terminal 86 to aid in terminal retention. The first layer 94 is between the shim tape 92 and the surface 66 of the carrier tape 32; therefore, its thickness must be considered when determining the desired thickness of the shim tape 92 to achieve the standard height 64 for the terminal 88. A second layer of adhesive tape 95 is optionally disposed over both of the terminals 86 and 88, as shown in FIG. 7, and a final layer of cover tape 34 is arranged in place over the entire assembly. Ultrasonic welds 38 secure the cover tape 34 to the carrier tape 32 on opposite sides of each terminal, as shown in FIG. 6. The terminals 86 and 88 are positioned axially so that their crimp zones 96 and 98, respectively, will be in alignment with the indentors 70 when the tape and terminal package 84 is loaded into the tool 50 for use and the terminals are advanced into the workstation 74. The tape and terminal package 84 can be loaded into the tool 50 and used to alternately terminate the two terminals 86 and 88, in seriatim, to conductors, as required. The tape and terminal package 84 can be thought of as a kit of different terminals needed to complete a particular manufacturing operation. Other kits of different terminals are possible as well. For instance, some or all of the terminals 52-1 through 52-5 may be included on a single carrier tape 32 to form a kit having a desired combination of those terminals. An important requirement is that all of the different terminals on a single carrier tape must be from the same range of terminals. This will assure that all of the terminals on that carrier tape will be accepted by the tool 50.

Figure 8:
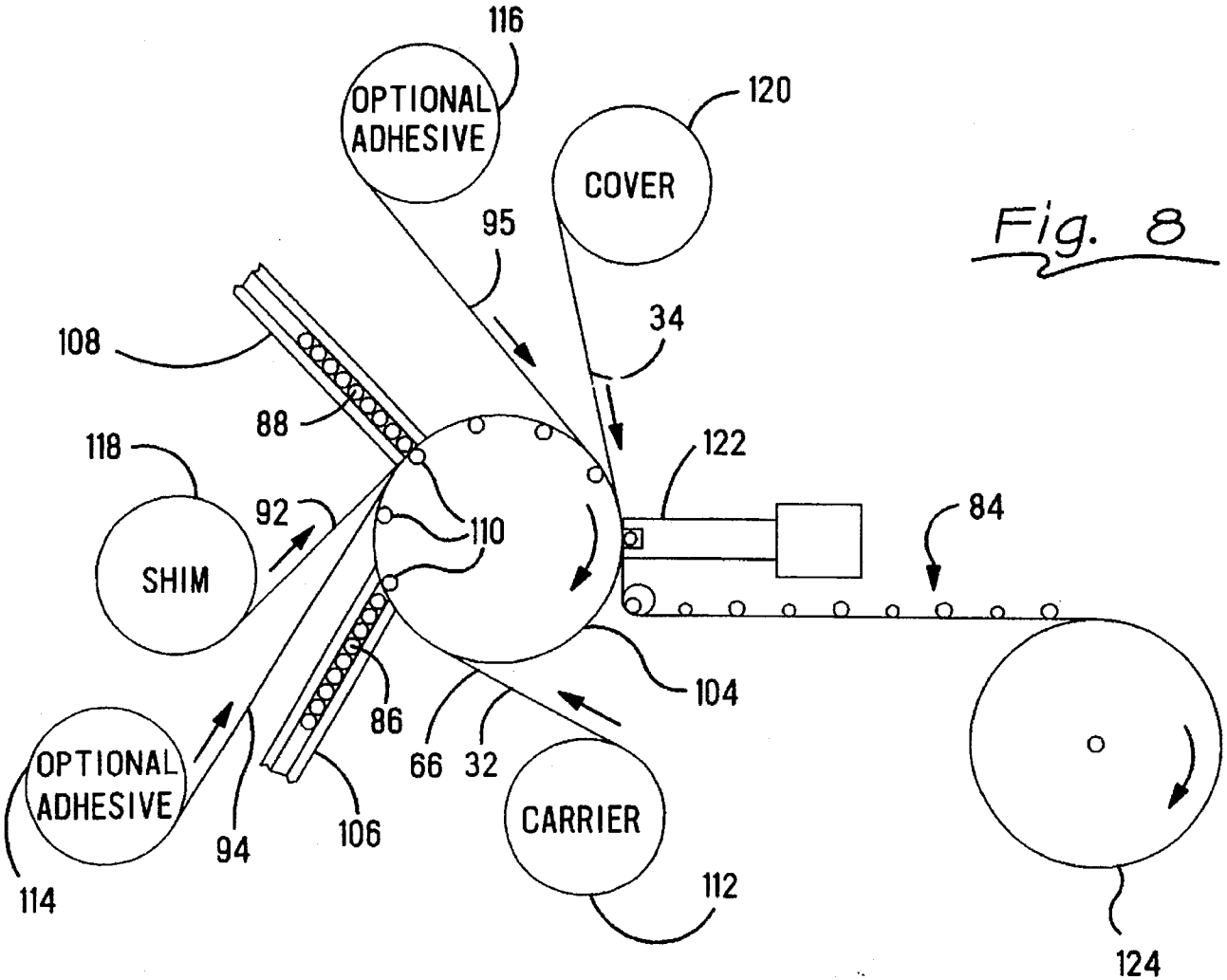
FIG. 8 is a schematic representation of an apparatus and method for making the carrier tape and terminal package shown in FIGS. 5 and 6.

A method and apparatus for making the tape and terminal packages 30 and 84 is schematically shown in FIG. 8. A carousel 104 is shown with two terminal supply magazines 106 and 108 arranged to feed the two sizes of terminals 86 and 88, respectively, into cavities 110 in the carousel. The carrier tape 32 is fed from a reel 112 onto the periphery of the carousel just upstream from the supply magazine 106. The two optional layers of adhesive tape 94, 95 are fed from an upstream reel 114 and a downstream reel 116, respectively, onto the carousel 104 on either side of the magazine 108. The shim 92 is fed from a reel 118 onto the carousel 104 over the first layer of adhesive tape 94, upstream from the magazine 108. The cover tape 34 is fed from a reel 120 onto the carousel 104 over the second layer of adhesive tape 95. An ultrasonic welder 122 is arranged just downstream from the point where the cover tape 34 joins the carousel for providing the ultrasonic welds 38. In operation, as the carousel 104 rotates, a large terminal 86 is injected, in turn, into every second cavity 110 in the periphery of the carousel in contact with the surface 66 of the carrier tape 32. The first layer of adhesive tape 94 is applied onto the surface 66 and over the terminal 86, followed by the shim tape 92. A small terminal 88 is injected into each vacant cavity 110, between the cavities containing the larger terminals 86. The second layer of adhesive tape 95 is then applied in contact with the shim 92 and over the terminals 88, and the cover tape 34 applied over the entire assembly. The cover tape 34 is then ultrasonically welded by the welder 122 and the tape and terminal package wound onto a takeup reel 124. This yields the tape and terminal package 84 shown in FIG. 7. To make the tape and terminal package shown in FIG. 3, the magazine 106 and the reel 114 of adhesive tape are disabled or removed from the system and the above procedure repeated without these elements.

It will be understood by those skilled in the art that the above procedure may be modified to produce virtually any combination of terminals in a tape and terminal package to meet manufacturing requirements as long as all of the terminals are within the same range of terminals accepted by the tool 50. For example, using the terminals depicted in FIG. 5, a tape and terminal package may be produced having two terminals 52-1 followed by a terminal 52-5 followed by three terminals 52-3, this cycle being repeated any number of times as desired. To accomplish this the apparatus depicted in FIG. 8 would have to include a third magazine for the third terminal, a second reel of shim, and a third reel of adhesive tape, all being appropriately placed around the carousel 104. Any number of magazines and reels of shim and adhesive tape may be utilized in a similar manner to produce various combinations of tape and terminal packages.

An important advantage of the present invention is that a single tool can be utilized to apply a variety of different terminals without the need for positioners within the tool. Additionally, kits of terminals of different sizes and types can be intermixed on the same carrier tape and processed by the same tool without adjustments or changes to the tool.

I claim:

1. A package containing a plurality of electrical terminals for holding and accurately positioning each said terminal, in seriatim, both axially and laterally with respect to a workstation in a tool that electrically attaches said terminal to a conductor, comprising:

(a) a carrier tape having a width, a length, and a major surface, and a datum running along said length;

(b) a cover tape attached to said major surface of said carrier tape, thereby forming a plurality of pockets along said major surface;

(c) a plurality of electrical terminals, each of which includes a crimping barrel having a longitudinal centerline and a crimping zone, each said terminal being held in a respective one of said pockets so that its crimping zone is spaced a standardized distance from said datum, said plurality of terminals being taken from a range of terminals of differing nominal sizes; and (d) a shim tape disposed between at least some of said plurality of terminals and said major surface.

2. The package according to claim 1 wherein said shim tape has a thickness selected to position said longitudinal centerline of each of said some of said terminals a standard height above said major surface.

3. The package according to claim 2 wherein all of said plurality of terminals are substantially identical in size and shape.

4. The package according to claim 2 wherein said some of said terminals are of a relatively smaller size and others of said plurality of terminals are of a relatively larger size.

5. The package according to claim 4 wherein said shim tape is disposed between each of said relatively larger terminals and said cover tape but not between said relatively larger terminals and said major surface of said carrier tape.

6. The package according to claim 5 including a layer of adhesive tape over each of said relatively larger terminals, and between said major surface of said carrier tape and said shim tape.

7. The package according to claim 6 including a layer of adhesive tape over each of said relatively smaller terminals and over said shim tape.

8. A package containing a plurality of electrical terminals for presenting said terminals, in seriatim, to a tool for use thereby, comprising:

(a) a carrier tape having a width, a length, and a major surface;

(b) a cover tape attached to said carrier tape so as to form a plurality of pockets;

(c) a plurality of electrical terminals, each of which includes a crimping barrel having a longitudinal centerline and a crimping zone, wherein some of said terminals are of a relatively larger size and others of said terminals are of a relatively smaller size, each said terminal being held in a respective one of said plurality of pockets so that its crimping zone is in alignment with the crimping zone of each adjacent terminal; and (d) a shim tape between only said others of said terminals and said carrier tape.

9. The package according to claim 8 wherein said relatively smaller size terminals vary in size, each having a shim tape between it and said carrier tape, said shim tape having a thickness that positions said longitudinal centerline of its respective said terminal above said carrier tape so that said longitudinal centerlines of all of said relatively smaller size terminals are the same distance from said carrier tape.

10. The package according to claim 8 including a layer of adhesive tape over each of said relatively larger size terminals, and between said major surface of said carrier tape and said shim tape.

11. The package according to claim 10 including a layer of adhesive tape over each of said relatively smaller size terminals and over said shim tape.

12. In a method of making a tape and a terminal package for use in a terminal applicator tool, the steps comprising:

(a) advancing a carrier tape from a supply reel at a downstream position to a take-up reel at an upstream position;

(b) positioning a first terminal on the carrier tape;

(c) applying a layer of shim tape over a portion of said carrier tape and said first terminal;

(d) positioning a second terminal on said shim tape, said second terminal comprises a different nominal size relative to said first terminal;

(e) applying a cover tape adjacent said first and second terminals and said layer of shim tape; and (f) attaching said cover tape to said carrier tape to form respective pockets thereof for holding and positioning said first and second terminals.

13. The method according to claim 12, wherein before applying the shim tape to the first terminal a first layer of adhesive tape is applied over said first terminal and a portion of said carrier tape.

14. The method according to claim 13, wherein after application of the shim tape but before applying the cover tape to the first and second terminals, a second layer of adhesive tape is applied over said first and second terminals and a portion of said shim tape.

* * * * *